United States Patent [19]

Stowe

[11] 3,973,459

[45] Aug. 10, 1976

[54] MAT CUTTING APPARATUS

[76] Inventor: Charles Terry Stowe, 3553 S. Urbana, Tulsa, Okla. 74135

[22] Filed: Nov. 6, 1975

[21] Appl. No.: 629,279

[52] U.S. Cl. ..... 83/455; 83/468; 83/522; 83/581; 83/614; 83/824

[51] Int. Cl.[2] ..... B26D 3/02; B26D 7/02

[58] Field of Search ..... 83/455, 468, 522, 581, 83/614, 824

[56] References Cited

UNITED STATES PATENTS

| | | | |
|---|---|---|---|
| 491,307 | 2/1893 | Gaylord | 83/455 X |
| 1,235,459 | 7/1917 | Gaffney | 83/455 |
| 3,237,497 | 3/1966 | Cook | 83/455 X |
| 3,527,131 | 9/1970 | Ellerin | 83/581 X |
| 3,897,706 | 8/1975 | Martin | 83/455 |

*Primary Examiner*—Frank T. Yost

*Attorney, Agent, or Firm*—Head, Johnson & Chafin

[57] ABSTRACT

A mat bevel cutting method and apparatus having a pivotal mounted cutting guide rail in conjunction with sidewalls which serve to hold the matting material in place and squared during the cutting operation. The apparatus also includes built-in auxiliary measuring and alignment tools to facilitate accurate alignment and cutting.

5 Claims, 6 Drawing Figures

MAT CUTTING APPARATUS

BACKGROUND OF THE INVENTION

1. Field of the Invention

The present invention relates to a mat bevel cutting apparatus and more particularly to an apparatus which is particularly designed and constructed to facilitate the entire preparation of matting material for picture framing from the step of sizing the material to the completed bevel cut for framing the picture.

2. Description of the Prior Art

One of the primary problems confronting a frame shop technician is the preparation of mats for use in outlining a picture to be framed. There are machines presently available which are both complicated and costly for the preparation of some mats but are normally prohibitively expensive for the individual frame shop owner. Therefore, most frame shop owners utilize some rough makeshift device for cutting the mats or are forced to accomplish the entire operation by means of a knife blade and straight edge.

The art of mat cutting is old as is evidenced in the patent to McCall, U.S. Pat. No. 570,180, issued 1896 for a "Bevel Edge Cardboard Cutter". The patent to McCall recognized that there is a problem in holding down the matting material during the cutting operation and therefore mounted his cutting guide rail pivotally so that the guide rail itself could help hold down the matting material. However, by pivotally mounting his guide rail mechanism, he was foreclosed from incorporating sidewalls for the purpose of aligning and squaring the matting material within the machine.

The problem pointed out in the above description of the patent to McCall has been prevalent throughout the manufacturing of bevel picture mat cutters. Further, most devices that have been manufactured or are presently available have a rather complicated measuring apparatus built-in or the measuring has to take place by an ordinary scale and the use of a marking apparatus to mark the cutting points on the mat itself. The more recent patent to Ellerin, U.S. Pat. No. 3,527,131, issued 1970 for a "Mat Cutter" is indicative of the complicated measuring and blade guide apparatuses which are presently available on the market.

SUMMARY OF THE INVENTION

The present invention is particularly designed and constructed for overcoming the above disadvantages in providing a simply constructed mat cutting apparatus which is designed to accomplish the entire mat cutting operation from sizing of the mat to be used through the completion of the bevel cut of the opening therein.

The present invention utilizes a guide rail which is constructed from angle iron material having one side or leaf thereof extending upwardly to serve as a guide rail for the cutting mechanism. The other leaf of the angle iron guide rail rests directly on the matting material to be cut which serves to help hold the material in place and also provides an outer edge to use as a simple straight edge in the initial cutting of the material to size. The guide rail is pivotally mounted by a pair of elongated L-shaped bars to the outside edges of the cutting board. The mounting permits the outside edges of the cutting board to be provided with upwardly extending sidewalls which are parallel with respect to each other and perpendicular to the elongated guide bar thereby providing a squaring means for the material to be held in place thereby.

A movable fence apparatus is securable in place between the sidewalls in order to provide a stop for the edge for the material when it is placed in the bevel cutting position. The cutting mechanism itself consists of a group of plates sandwiched together in order to securely hold in place a standard off-the-shelf type single edge razor blade and simultaneously provide a groove for slidably receiving the upper edge of the angle iron guide rail therein.

An auxiliary measuring device is included which greatly simplifies the setting of the stop fence and the length cut of the blade itself. This auxiliary measuring device generally comprises an elongated scale member having a sliding block thereon and a stop member at one end. The scale member is provided with graduations from each end ascending toward the middle of the scale. The sliding block when fully moved to the stop member end of the scale provides a zero edge while the opposite end of the scale provides a second zero edge so that measurements of the matting material can be made from both edges thereof. The sliding block then serves as a handy device for checking the square alignment of the stop fence of the apparatus.

No scribing is necessary in predetermining the mat width or operation of the cutting tool. This, in eliminating previously required steps, also precludes the human error usually present in the scribing operation.

The cutting board itself, in order to facilitate holding the mat material in place is provided with a roughened or tacky surface directly beneath the guide rail means.

This machine can be produced inexpensively and it can easily be purchased by the "artist" himself for his own mat-cutting requirements. It can be maintained in the artist's studio thereby giving him ready access to his mat requirements and at a fraction of the cost of having mats custom cut in frame shops.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
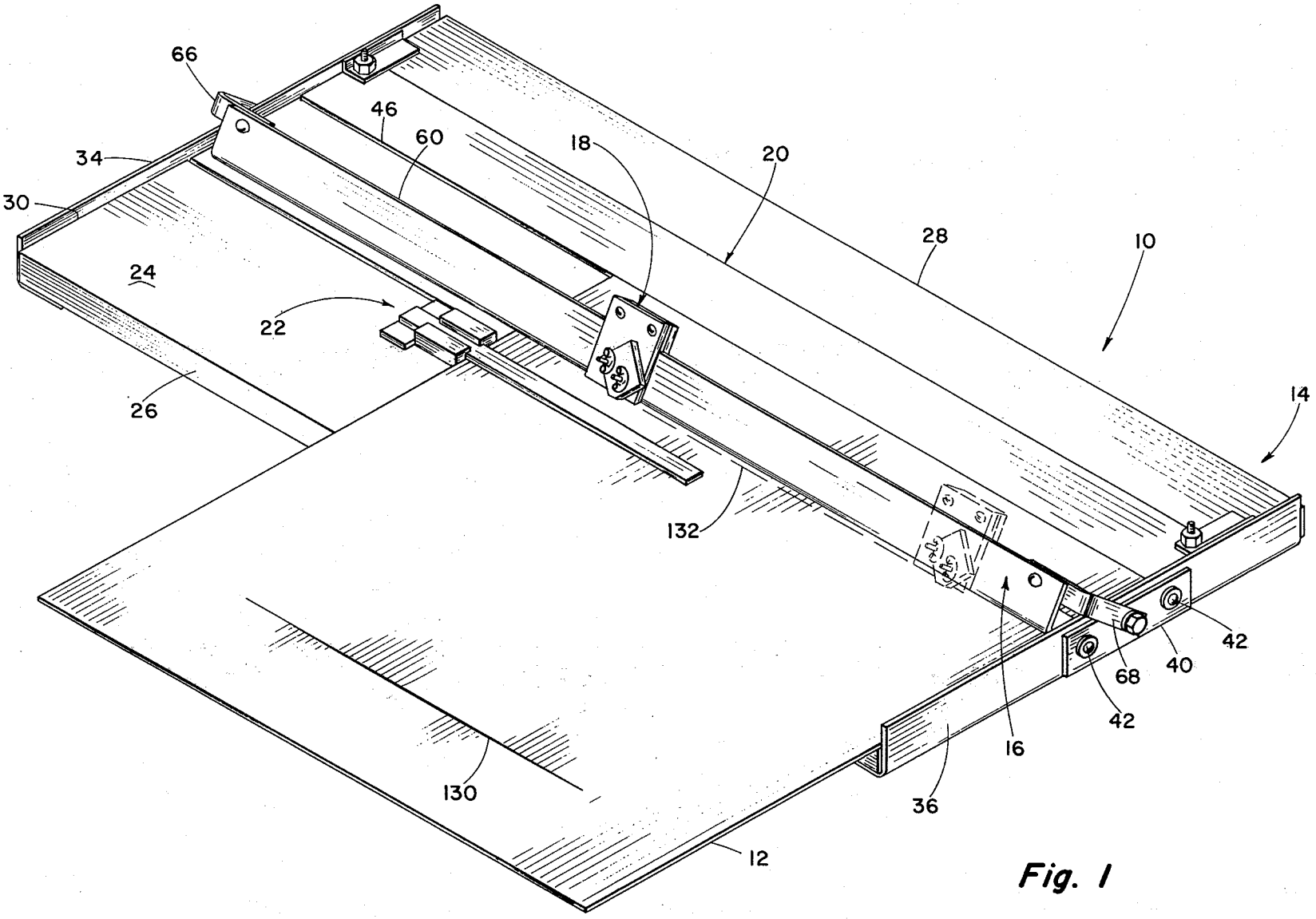
FIG. 1 is a prospective view of a mat cutting apparatus embodying the present invention.

Referring to the drawings in detail, reference character 10 generally indicates a mat cutting apparatus for preparing matting material indicated by reference character 12 for picture framing and the like. The apparatus 10 generally comprises a baseboard apparatus 14 having guiderail means 16 pivotally attached thereto and having a movable cutting apparatus 18 for operation therewith. The apparatus 10 also comprises a fence stop means 20 and an auxiliary measuring device 22.

The baseboard apparatus 14 comprises a rectangular board 24 having a front edge 26, a rear edge 28 and opposite side edges 30 and 32. The side edges 30 and 32 are provided with upwardly extending sidewalls 34 and 36, respectively which are constructed to be parallel with respect to each other. The sidewalls 34 and 36 are further constructed from angle-iron material with the one leaf thereof extending under the baseboard 24 which provides some support therefore. The outside surface of each sidewall 34 and 36 is provided with a flat plate member 38 and 40 respectively which is adjustably attached thereto by means of screws 42 and oversize bores 44.

The upper surface of the board 24 is provided with an elongated vertical groove 46 which extends between the sidewalls 34 and 36 and is perpendicular thereto. The groove 46 is spaced a preselected distance from the rear edge 28 of the board 24. The upper surface of the board 24 is provided with an angled groove 48 which extends downwardly and away from groove 46 and is spaced therefrom. The angled groove 48 also extends between the sidewalls 34 and 36 and is perpendicular thereto. A strip of anti-skid material 50 is provided on the top surface of the baseboard 24 between the sidewalls 34 and 36 and is disposed between the grooves 46 and 48 for a purpose that will be hereinafter set forth.

The upper surface of the board is also provided with an elongated scale member 52 which is disposed along the inside edge of the sidewall 36 within a recess 54. The scale 52 is longitudinally adjustable within the recess 54 by means of a slot 56 at one end thereof and adjustment screw 58.

In ordinary operation of the apparatus, the scale is adjusted so that the 0 indicia is in direct alignment with the angled groove 48, again for a purpose that will be hereinafter set forth.

Figure 3:
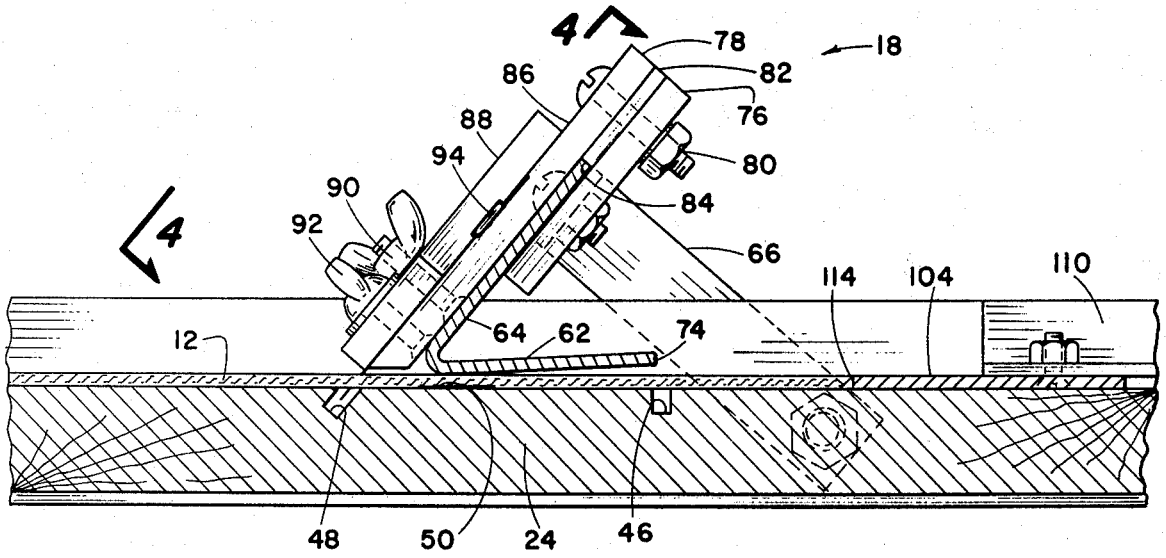
FIG. 3 is a side elevational sectional view taken along the broken lines 3—3 of FIG. 2.

The guide rail means generally depicted by reference character 16 comprises an elongated angle iron bar 60 made up of two leaf members 62 and 64 which are joined along one edge to form a substantially V-shaped cross-section which is best shown in FIG. 3. The bar 60 however is constructed from a single piece and folded to create the leaf members 62 and 64 as opposed to actually joining them together by welding or other means. Each end of the leaf member 64 is provided with an L-shaped attachment bar 66 and 68, one leg of each said bar being pivotally connected to the baseboard side plates 38 and 40, respectively, by means of oppositely disposed pivot pins 70 and 72 respectively.

The pivot arms 66 and 68 are disposed so as to support the elongated bar 60 in position between the grooves 46 and 48 in the baseboard 24. The leaf member 62 of the guide rail 60 has an outer edge depicted as 74 and is disposed to be directly above the groove 46 when the guide rail 60 is pivoted into contact with the upper surface of the baseboard 24 as shown in FIG. 3. At the same time when the guide rail 60 is in substantial contact with the upper surface of the baseboard 24, the plane of the leaf member 64 is in substantial alignment or parallel with the angled groove 48 and slightly rearward thereof. The portion of the leaf member 62 contacting the upper surface of the baseboard 4 contacts it at or directly above the roughened strip portion 50. The rear edge 74 of the leaf 62 is raised slightly off the upper surface of the board.

Figure 4:
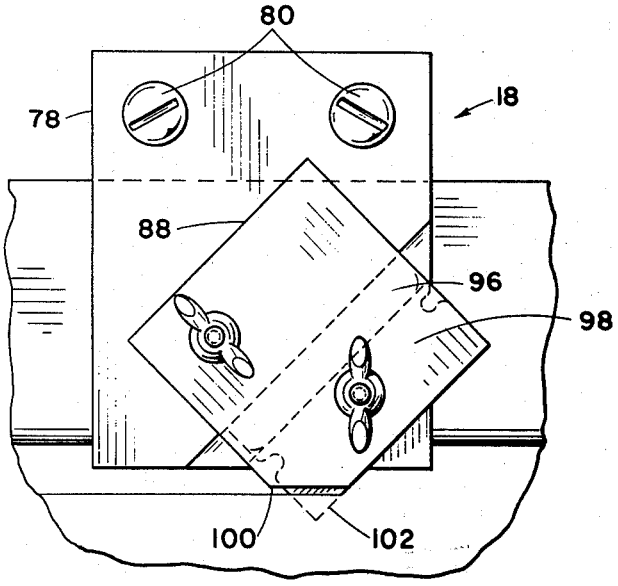
FIG. 4 is a detailed view of the cutting apparatus taken along the broken lines 4—4 of FIG. 3.
Figure 5:
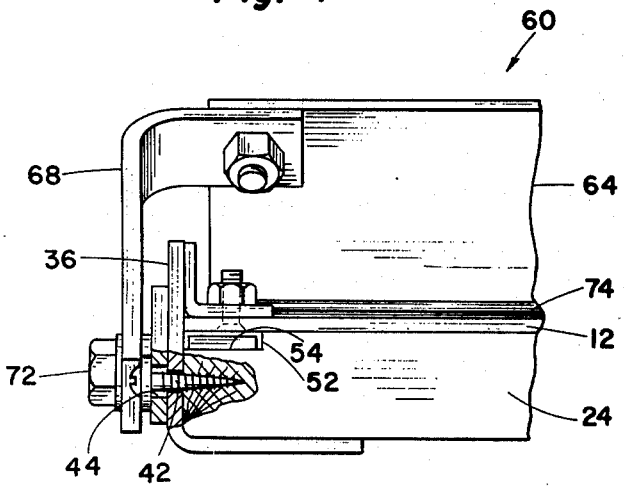
FIG. 5 is a detail of one end of the guide rail mechanism taken along the broken lines 5—5 of FIG. 2.
Figure 6:
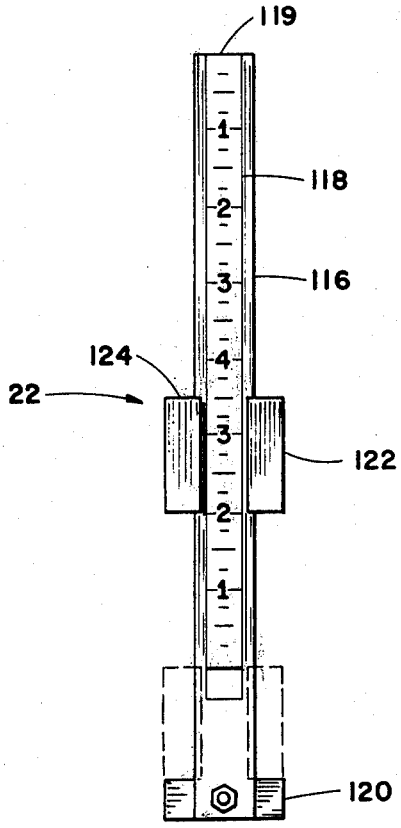
FIG. 6 is a plan view of an auxiliary scaling apparatus used in conjunction with the mat cutting apparatus.

The view shown in FIG. 4 depicts a piece of matting material 12 located on the upper surface of the board 24 and having the leaf member 62 resting thereon. In order to place the mat 12 in the shown position, the entire guide rail 60 is pivoted upwardly by means of the attachment arms 66 and 68 while a mat 12 is put into place.

The blade holding apparatus 18 comprises a pair of flat plate members 76 and 78 which are attached together by means of a bolt and nut 80 and spaced apart by a slide block 82 sandwiched therebetween. The slide block 82 is smaller than the plate members 76 and 78 thereby forming a groove 84 between the said blocks or plate members 76 and 78. The size of the slide block 82 is determined by the thickness of the leaf 64 of the guide rail so that the upper edge of outer edge thereof is slidably received within the groove 84. It is noted that the slide block 82 is best constructed from a teflon or phenolic block material which is easily slidable on the edge of the leaf member 64 of the guide rail 60.

The outer surface 86 of the plate member 78 is disposed to lie directly in the plane of the angle groove 48 when the guide rail 60 is in its downward position as shown in FIG. 3. A third plate member 88 is secured to the outer surface 86 of the plate member 78 by means of a pair of bolt and wing nuts 90 and 92. The plate members 78 and 88 are provided with a pair of aligned grooves thereby forming a slot 94 which is disposed at an angle of approximately 45° and sized to receive the backbone or ridge plate 96 of an ordinary standard single edge razor blade 98. The lower edge 100 of the plate 88 is cut off in order to allow the lower corner and cutting edge 102 of the blade 98 to extend therebelow. It is best to orient the plate member 88 at an angle corresponding to that of the razor blade 98 so that the opposite and unused corner of the blade 98 is covered by the plate 88 for safety purposes.

The lower cutting edge or corner 102 of blade 98 extends downwardly into the groove 48 when the guide rail 60 is pivoted downwardly in contact with the upper surface of the board 24 or the mat 12 placed thereon as the case may be.

The stop fence 20 generally comprises an elongated flat bar 104 which extends between the sidewalls 34 and 36 and is substantially perpendicular thereto. The bar 104 is not attached to the baseboard but is slidably movable thereon. Each end of bar 104 is provided with plate members 106 and 108 each having an upwardly extending guide wall 110 and 112 respectively on the outer edge thereof. The guide walls 110 and 112 are disposed to be in sliding engagement with the inside surface of the sidewalls 34 and 36 of the baseboard 24. The sidewalls serve to substantially maintain the bar 104 in an orientation perpendicular to the said sidewalls 34 and 36. The plate members 106 and 108 are disposed rearwardly of the leading edge of the bar designated at 114. The leading edge 114 of the fence is alignable with the scale 52.

The auxiliary scale member 22 comprises an elongated scale rod 116 which is provided with a scale indicia 118 on the upper surface thereof. The indicia 118 graduates from 0 to 4 from one end of the scale and descending back to a second 0 near the opposite end thereof. The opposite end of the rod 116 is provided with a transverse T-stop member 120. A sliding block member 122 is slidably secured to the rod 116 and movable from one end to the other thereof. The length of the block member 122 is such that when the block member 122 is disposed against the stop member 120 the forward edge 124 thereof is in alignment with the second 0 indicia.

The steps utilizing the apparatus 10 are as follows: The overall sizing of the matting material may be accomplished by simply inserting the matting material under the guide rail 60 and cutting the outside edge thereof using an ordinary knife blade, razor blade or the like along the rear edge 74 of the leaf member 62 allowing the tip of the blade (not shown) to enter the groove 46 of the baseboard. While making these cuts it is obvious that the inside surfaces of either of the sidewalls 34 and 36 may be used as a squaring edge for the material 12.

After the board has been cut to its overall desired dimensions, the width of the finished mat is determined. For example, referring now to FIG. 2, the fence stop member 104 is adjusted so that the forward edge 114 is in alignment with indicia 3 ½ on the scale 52. The measuring apparatus 22 is then placed in the position as shown at reference character 1 in FIG. 2. The sliding block 122 is then held in place with respect to the scale member 116 and the apparatus 22 is then moved the opposite end of the board at the position shown at reference character 2. The fence member 104 is then adjusted so that it is perfectly square or parallel with the rear edge 28 of the baseboard 24. This aligns the leading edge 114 of the stop fence member 104 perpendicular with respect to the sidewalls 34 and 36 and at the position 3 ½ of the scale 52. The leading edge 114 of the fence member 104 is now 3½ units from the angled groove 48.

The fence member 104 is then locked into place by means of a pair of hand operated clamps or the like 126 and 128. The clamps 126 may be ordinary paper clip type clamping means which is placed over the upper edge of the guide wall 110 and the baseboard sidewall 34. Likewise, the clamp 128 is placed over both the fence guide wall 112 and the baseboard sidewall 36.

Figure 2:
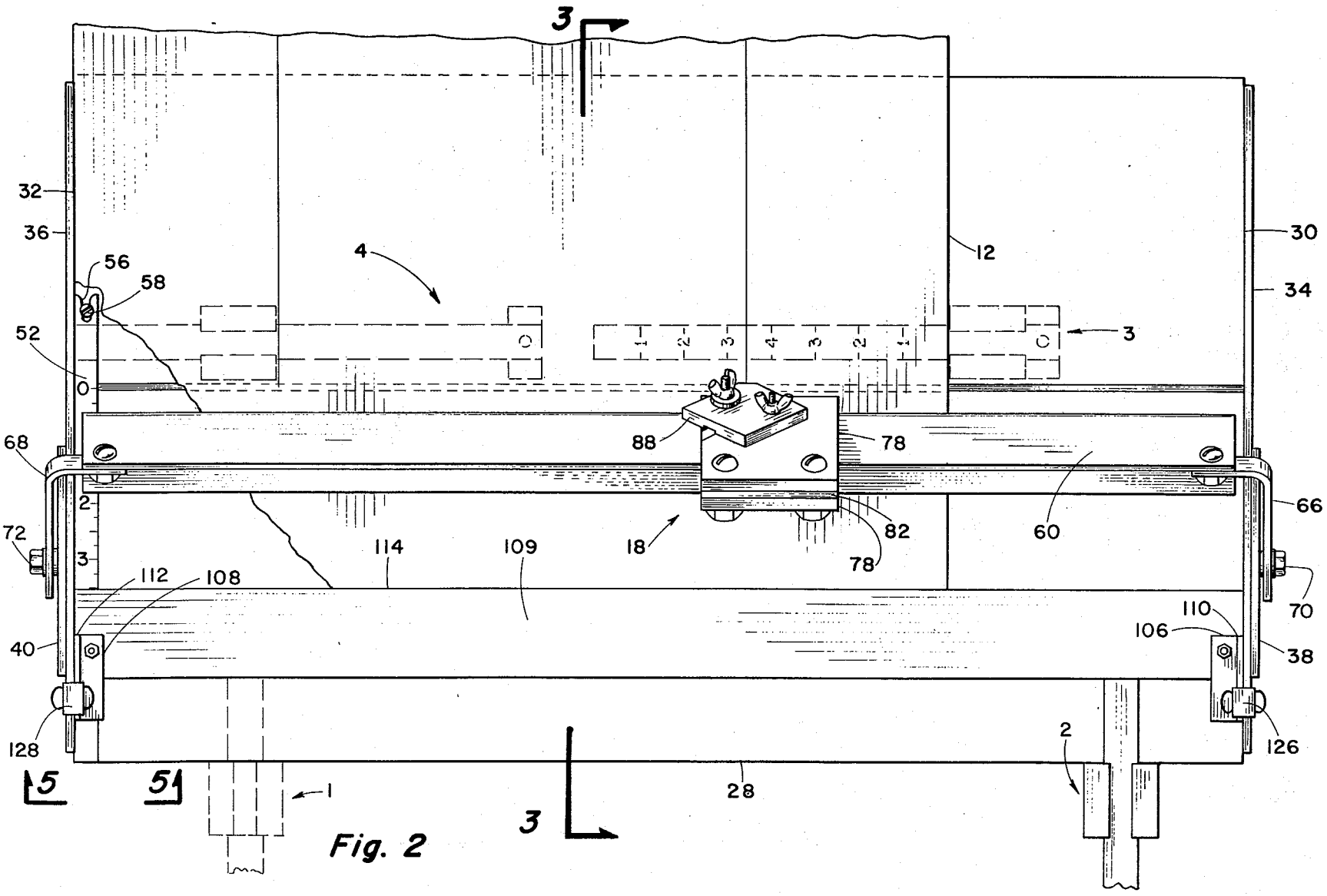
FIG. 2 is a plan view of the mat cutting apparatus of FIG. 1.

The matting material is then placed under the guide rail 60 with one edge thereof against the leading edge 114 of the stop fence and the right angled edge thereof being against the inside surface of the sidewall 36. The auxiliary measuring tool 22 is then placed in position 3 as shown in FIG. 2 with the sliding block member moved all the way back against the stop member 120. The blade holding mechanism 18 is placed on the leaf member 64 of the guide rail 60 so that the cutting blade corner 102 is directly in line with the indicia mark 3½ of the auxiliary measuring tool 22.

The next step is to move the auxiliary measuring tool 22 to the opposite side of the mat member at position 4 butting the forward end 119 directly against the inside surface of the sidewall 36 and placing the sliding block 122 at a position so one edge thereof is adjacent to the opposite 3½ position on the scale.

The cutting holder means 18 is then pressed downwardly thereby inserting the corner of the blade through the matting material as clearly shown in FIG. 4. The blade is then slidably moved toward the sidewall 36 until the cut is completed opposite the 3½ marking on the auxiliary scale member. The mat material is then rotated 180° so that the first bevel cut indicated by reference character 130 is forward of the cutting board as shown in FIG. 1. The auxiliary measuring apparatus 22 is then moved back to position 3 shown in FIG. 2 and steps 3 and 4 are repeated thereby cutting the opposite bevel cut shown by the dashed lines 132 in FIG. 1.

The matting material is then rotated 90° and a cut is made between the end of the cuts 130 and 132 and finally the mat material is rotated 180° to complete the bevel cut. The center portion of the mat that has been cut free is removed thereby leaving a finished picture mat.

From the foregoing, it is apparent that the invention provides a mat cutting apparatus which is particularly designed and constructed to permit the accurate cutting of the bevel mat for picture framing and the like which is accurate and professional without the use of a complicated and expensive machine.

Whereas, the present invention has been described in relation to the drawings attached hereto, other and further modifications apart from those shown or suggested herein may be made within the spirit and scope of the invention.

What Is claimed is:

1. A picture mat cutting apparatus comprising:

a baseboard having a flat upper surface for supporting matting material thereon, a straight back edge and oppositely disposed parallel side edges perpendicular to said back edge, parallel sidewalls attached to each side edge and extending upwardly above the board upper surface, a first L-shaped support arm having one end thereof pivotally secured to the outside surface of one sidewall and the free end extending over said sidewall above the board upper surface, a second substantially identical oppositely disposed L-shaped support arm having one end pivotally secured to the outside surface of the opposite sidewall and extending over said sidewall above the board upper surface, a cutter guide rail means comprising upper and lower elongated flat leaves joined along the edge to form a V-shaped cross-section and disposed parallel to the back edge of the board, the upper leaf being attached at each end to the free ends of the support arms and movable therewith so that the lower leaf is contactable with the board upper surface and the rear edge of said lower leaf extends rearwardly and the edge of the upper leaf extends upwardly and rearwardly when the guide rail is pivoted downwardly toward the board upper surface, cutting means slidably attachable to the upper leaf edge and having a cutting blade on the lower edge thereof.

2. A picture mat cutting apparatus as set forth in claim 1 wherein the cutting means comprises a plate means having a slide groove for receiving the edge of the guide rail upper leaf therein, a blade holder plate attachable to the plate means and including means for securing a cutting blade therebetween.

3. A picture mat cutting apparatus as set forth in claim 1 and including a vertical groove in said baseboard upper surface extending between the sidewalls directly beneath the rear edge of the lower guide rail leaf, an angled groove disposed forward of the first groove and extending forwardly and downwardly therefrom, said angled groove adjacent to and parallel to the plane of the upper guide rail leaf, and disposed to receive the cutting blade therein, and an anti-skid material strip on the board upper surface between the grooves directly under the guide rail means.

4. A picture mat cutting apparatus as set forth in claim 3 and including an elongated groove in said baseboard upper surface along the inside surface of one said sidewall, a scale member having upper indicia surface disposed in said groove, the indicia surface being in the same plane as the board upper surface and having a 0 graduation opposite said angled groove, an elongated fence stop member slidably disposed on the board upper surface and extending between the sidewalls, said fence having a front straight edge positionable with respect to the said scale member indicia surface and means for securing the ends of the fence to the said sidewalls.

5. A picture mat cutting apparatus as set forth in claim 4 and including an auxiliary measuring tool comprising an elongated scale rod having graduations on one surface thereof, the graduations starting at 0 at one end and ascending to a preselected maximum graduation near the middle of the scale and then descending to a second 0 graduation near the opposite end, stop member secured to the end of the scale rod adjacent the second 0 graduation, and a slide block slidably disposed on the rod and having a width such that when one edge is against the stop member the other edge is in alignment with the second 0 graduation.

* * * * *